US007343107B2

(12) United States Patent
Fujimaru et al.

(10) Patent No.: US 7,343,107 B2
(45) Date of Patent: Mar. 11, 2008

(54) IMAGE FORMING DEVICE

(75) Inventors: Masahiro Fujimaru, Kyoto (JP); Katsunori Okabe, Joyo (JP)

(73) Assignee: Murata Machinery Ltd., Kyoto (JP)

( * ) Notice: Subject to any disclaimer, the term of this patent is extended or adjusted under 35 U.S.C. 154(b) by 178 days.

(21) Appl. No.: 11/381,394

(22) Filed: May 3, 2006

(65) Prior Publication Data

US 2006/0269302 A1 Nov. 30, 2006

(30) Foreign Application Priority Data

May 31, 2005 (JP) ..... 2005-158479

(51) Int. Cl.
*G03G 15/08* (2006.01)
*G03G 15/00* (2006.01)

(52) U.S. Cl. ..... 399/27; 399/13; 399/107

(58) Field of Classification Search ..... 399/13, 399/27, 30, 61, 64, 65
See application file for complete search history.

(56) References Cited

U.S. PATENT DOCUMENTS 6,397,016 B1 * 5/2002 Katakabe et al. ..... 399/27
2006/0171727 A1 * 8/2006 Inui et al. ..... 399/27

FOREIGN PATENT DOCUMENTS

JP 08-194367 7/1996

* cited by examiner

*Primary Examiner*—Hoang Ngo
(74) *Attorney, Agent, or Firm*—Keating & Bennett, LLP

(57) ABSTRACT

An image forming device includes a front cover which can be opened and closed, a remaining amount detecting sensor for detecting a remaining amount of toner, and a moving mechanism which moves the remaining amount detecting sensor between a retracted position and a detecting position. The moving mechanism includes a link member, an urging spring, and a sensor mounting member. The remaining amount detecting sensor is elevated and lowered via the sensor mounting member directly by the movement of the link member.

19 Claims, 5 Drawing Sheets

IMAGE FORMING DEVICE

BACKGROUND OF THE INVENTION

1. Field of the Invention

The present invention relates to a technology for simplifying a mechanism for detecting a status in an image forming device and reducing a number of components of the image forming device.

2. Description of the Related Art

Since an image forming device such as a printer fuses toner on paper to print out an image, the image forming device cannot print out an image when the toner runs out. Therefore, the image forming device is required to monitor a remaining amount of the toner at all times. A conventional image forming device includes an optical sensor for detecting the remaining amount of the toner.

When the conventional image forming device determines that the toner has run out according to a detection result of the optical sensor, a fact that the toner has run out is displayed on a display or the like. When an operator confirms the display, the operator opens a front cover and takes out and replaces a developing unit along with a toner cartridge (a container accommodating the toner).

The optical sensor, which monitors the remaining amount of the toner, is provided on a path along which the developing unit passes when taken out by the operator. Therefore, when the operator replaces the toner cartridge, the optical sensor is required to be retracted beforehand. In the conventional image forming device, a driving mechanism such as a motor is provided for moving the optical sensor to a retracted position. At a point in time when an open-close sensor detects that the front cover has been opened, the driving mechanism is driven to move the optical sensor to the retracted position. That is, the conventional image forming device requires the driving mechanism for moving the optical sensor and a control processor for controlling the driving mechanism.

SUMMARY OF THE INVENTION

In order to overcome the problems described above, preferred embodiments of the present invention reduce the number of components of an image forming device to reduce manufacturing costs of the image forming device and to simplify processing.

According to a preferred embodiment of the present invention, an image forming device fuses toner to print an image. The image forming device includes a housing, a cover, a container, a detecting unit, a link member, and a moving mechanism. The cover is mounted on the housing of the image forming device such that the cover can be opened and closed. The container accommodates the toner. The container can be inserted and removed with respect to the housing. The detecting unit detects a remaining amount of the toner in the container. The link member moves in response to an opening or closing movement of the cover. The moving mechanism moves the detecting unit between a retracted position and a detecting position via the link member.

According to another preferred embodiment, the container includes a semi-transparent sensing window. The detecting unit detects a presence or an absence of the container according to a light intensity of a detecting light passing through the sensing window.

According to another preferred embodiment, the image forming device further includes an open-close sensing unit for detecting an opened state or a closed state of the cover. The detecting unit determines a presence or an absence of the container according to the opened or the closed state of the cover detected by the open-close sensing unit and the light intensity of the detecting light.

As described above, the image forming device includes the moving mechanism for moving the detecting unit between the retracted position and the detecting position by the link member which moves in response to the opening or the closing movement of the cover. Accordingly, the image forming device is not required to include a driving mechanism (for example, a motor) for retracting the detecting unit. As a result, the number of components can be reduced and the manufacturing costs of the image forming device can be minimized.

The container includes the semi-transparent sensing window, and the detecting unit detects the presence or the absence of the container according to the light intensity of the detecting light that passes through the sensing window. Accordingly, the image forming device is not required to include a separate sensor for detecting the presence or the absence of the container. As a result, the number of components can be reduced and the manufacturing costs of the image forming device can be minimized.

Furthermore, the image forming device also includes the open-close sensing unit for detecting the opened or the closed state of the cover. The detecting unit detects the presence or the absence of the container according to the opened or the closed state of the cover detected by the open-close sensing unit and the light intensity of the detecting light. As a result, the image forming device can accurately determine when the detecting unit is located at the retracted position and when the container is not inserted.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

With reference to the drawings, a description will be made of preferred embodiments of the present invention.

Figure 1:
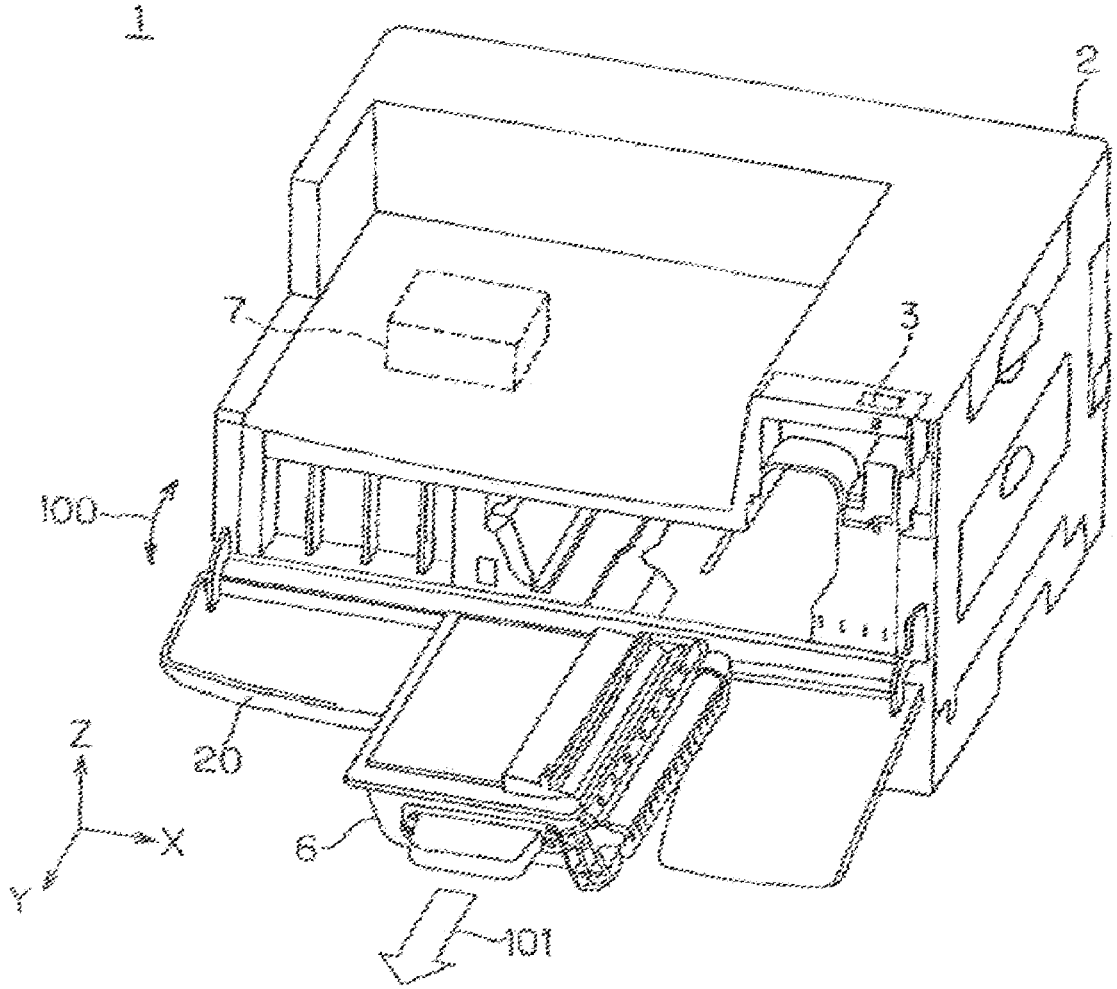
FIG. 1 is an exterior perspective view illustrating a state in which a developing unit is being removed from an image forming device according to a preferred embodiment of the present invention.
Figure 2:
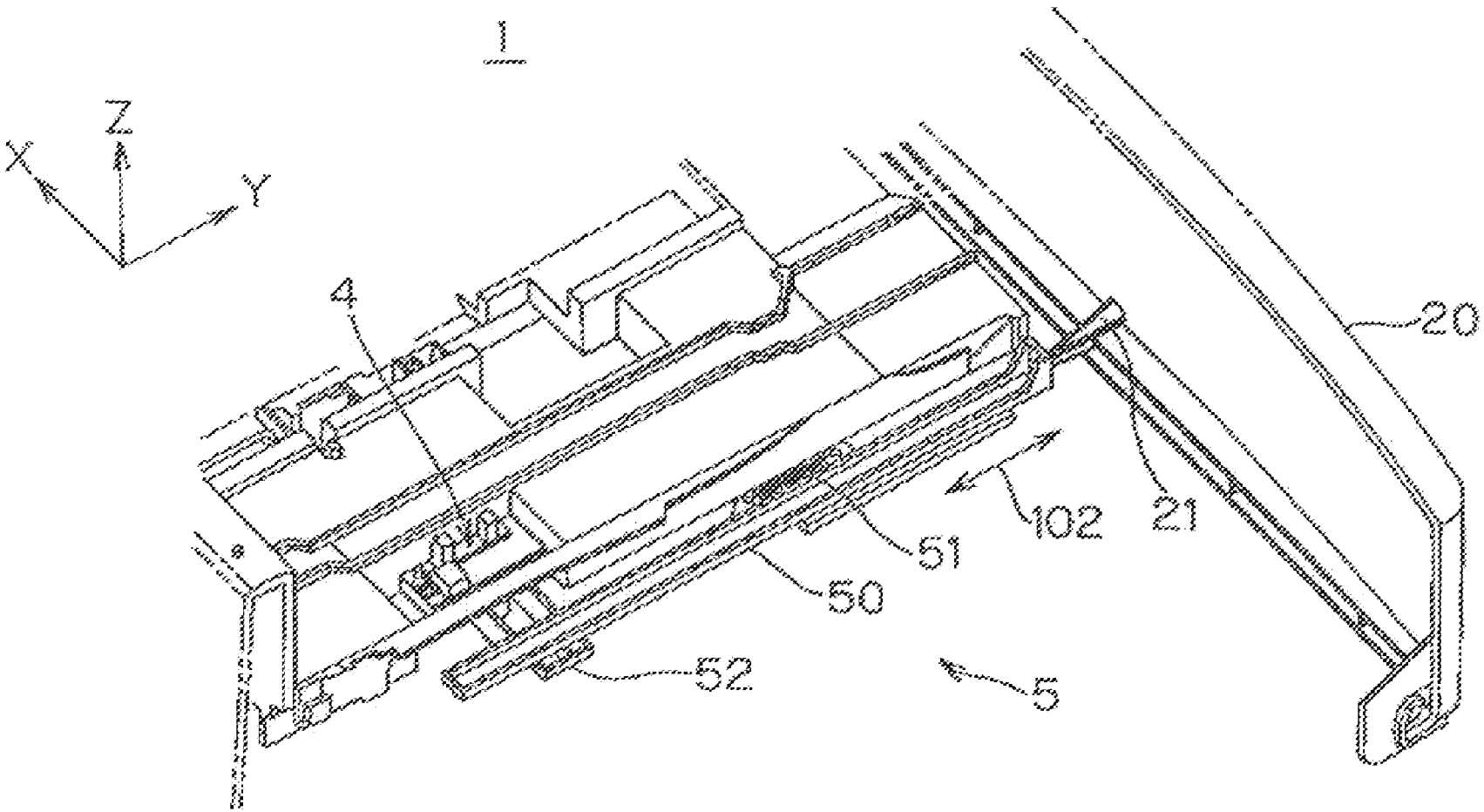
FIG. 2 illustrates a remaining amount detecting sensor and a moving mechanism of the image forming device.

FIG. 1 is an exterior perspective view illustrating a state in which a developing unit 6 is being removed from an image forming device 1 according to a preferred embodiment of the present invention. FIG. 2 illustrates a remaining amount detecting sensor 4 and a moving mechanism 5 of the image forming device 1.

In FIG. 1 and FIG. 2, a portion of a housing 2 and an inner structure of the image forming device 1 are omitted as appropriate for convenience of the drawings. FIG. 2 illustrates a state in which a front cover 20 is closed. In FIG. 1 and FIG. 2, a Z-axis direction represents a vertical direction, and an X-axis and a Y-axis define a horizontal plane. The Z-axis, the X-axis, and the Y-axis define just a positional relationship and do not limit each direction described hereinafter. The same description applies for other drawings as well.

The image forming device 1 includes the housing 2 and the developing unit 6. The housing 2 protects an inner structure. The developing unit 6 primarily develops an image. As illustrated with dashed lines in FIG. 1, the image forming device 1 includes an open-close sensor 3, the remaining amount detecting sensor 4, the moving mechanism 5, and a control unit 7. The image forming device 1 is configured to print (form) an image by fusing the toner on paper.

The front cover 20 is mounted on a front side of the housing 2 such that the front cover 20 swings approximately 90 degrees around an axis substantially parallel to the X-axis as illustrated with an arrow 100 in FIG. 1. As illustrated in FIG. 2, a protrusion 21 protruding in a −Y direction is provided on a reverse side of the front cover 20. Under a state in which the front cover 20 is closed, the protrusion 21 contacts an end portion of a link member 50, described hereinafter, to push the link member 50 in the −Y direction.

As illustrated in FIG. 1, when the front cover 20 is opened, an operator can perform work on the inner structure of the image forming device 1. For example, the operator can take out the developing unit 6, or remove jammed paper inside.

The open-close sensor 3 is a reflective optical sensor, and irradiates a detecting light in a +Y direction. The open-close sensor 3 transmits to the control unit 7 an output signal indicating whether or not a light receiving portion (not illustrated) has received the irradiated detecting light.

Under a state in which the front cover 20 is closed, the detecting light irradiated by the open-close sensor 3 is reflected in a −Y direction by the front cover 20. The light receiving portion of the open-close sensor 3 receives the returned detecting light. Therefore, the open-close sensor 3 transmits to the control unit 7 an output signal indicating that the light receiving portion has received the detecting light.

Meanwhile, under a state in which the front cover 20 is opened, the detecting light irradiated by the open-close sensor 3 travels straight without being reflected. The light receiving portion of the open-close sensor 3 does not receive the detecting light. Therefore, the open-close sensor 3 transmits to the control unit 7 an output signal indicating that the light receiving portion has not received the detecting light. Further, the open-close sensor 3 continually monitors the state of the front cover 20 during an operation of the image forming device 1.

In the image forming device 1, the control unit 7 described hereinafter determines an opened or a closed state of the front cover 20 according to the output signal from the open-close sensor 3. For convenience of description, the output signal transmitted from the open-close sensor 3 will be referred to as "open-close information". In particular, the open-close information when the front cover 20 is opened will be referred to as "open information", and the open-close information when the front cover 20 is closed will be referred to as "close information".

Although not illustrated in detail in the drawings, the remaining amount detecting sensor 4 is preferably a transmissive optical sensor in which a light emitting portion and a light receiving portion are arranged facing one another. A detecting light irradiated from the light emitting portion towards the light receiving portion is received by the light receiving portion while being influenced by a substance existing in a light path (between the light emitting portion and the light receiving portion). The remaining amount detecting sensor 4 transmits to the control unit 7 an output signal indicating a light intensity of the detecting light received by the light receiving portion (hereinafter referred to as "light intensity information").

Further, the remaining amount detecting sensor 4 is controlled by a control signal from the control unit 7. The remaining amount detecting sensor 4 is switched between an ON state (a state in which the remaining amount detecting sensor 4 generates the light intensity information) and an OFF state (a state in which the remaining amount detecting sensor 4 does not generate the light intensity information).

Figure 3:
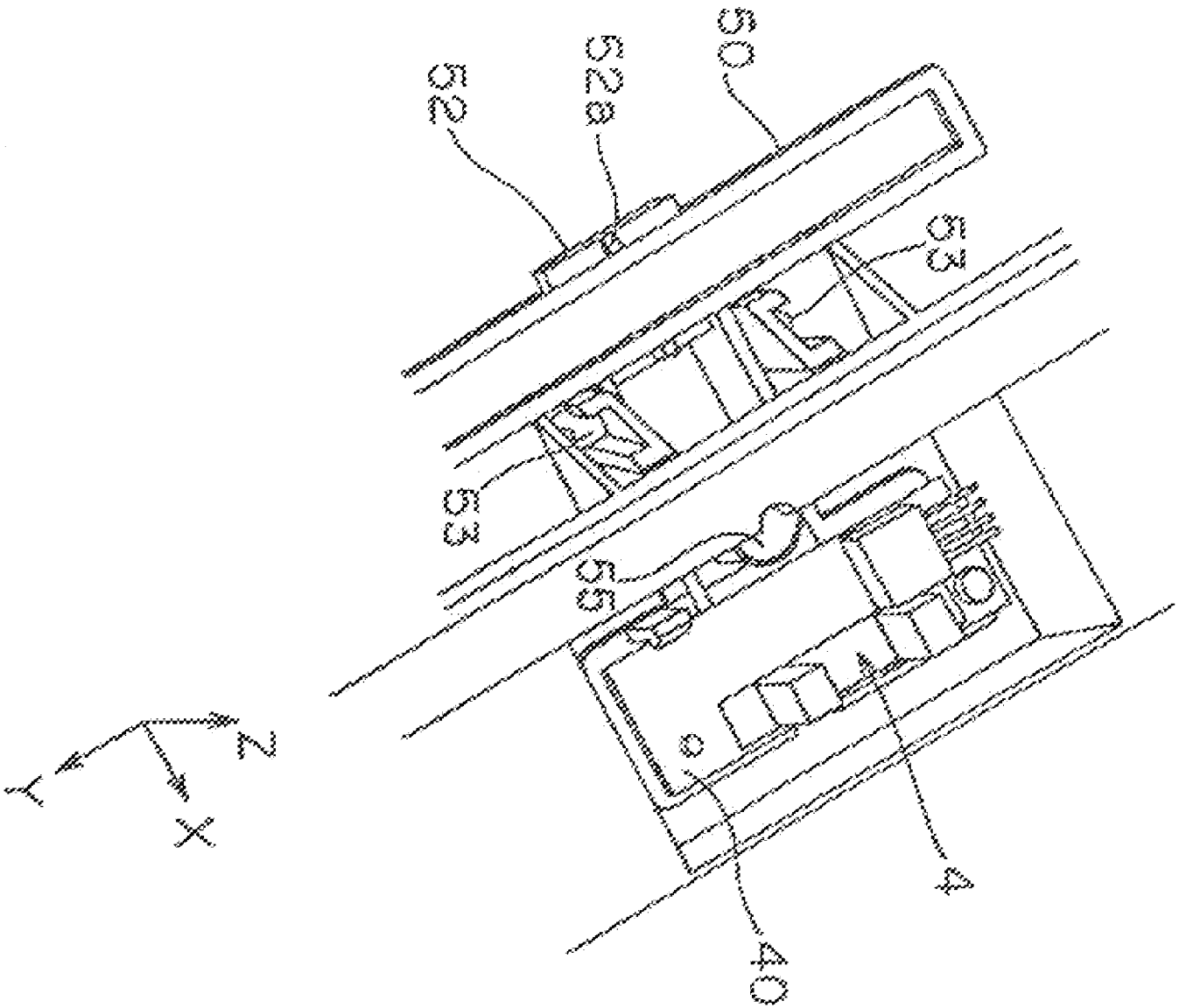
FIG. 3 is a schematic perspective view illustrating a link member, a sensor mounting member, and the remaining amount detecting sensor.
Figure 4:
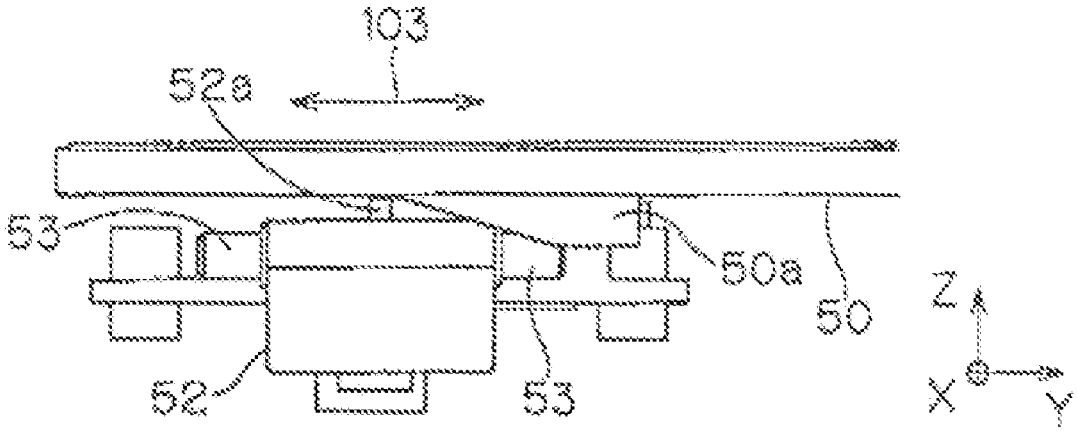
FIG. 4 is a side view illustrating a positional relation of the remaining amount detecting sensor and the moving mechanism.
Figure 5:
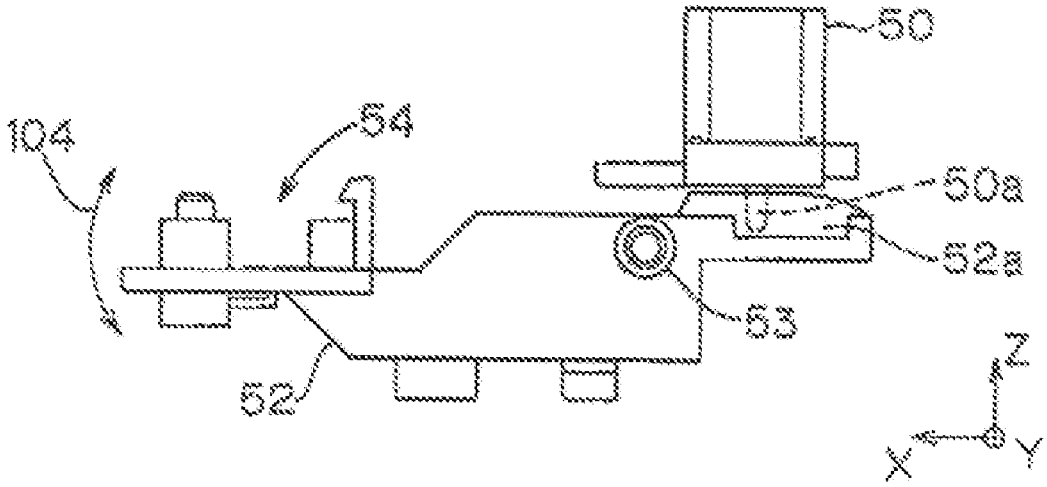
FIG. 5 is a rear view illustrating a positional relation of the remaining amount detecting sensor and the moving mechanism.

FIG. 3 is a schematic perspective view illustrating the link member 50, a sensor mounting member 52, and the remaining amount detecting sensor 4. FIG. 4 is a side view illustrating a positional relationship of the remaining amount detecting sensor 4 and the moving mechanism 5. FIG. 5 is a rear view illustrating a positional relationship of the remaining amount detecting sensor 4 and the moving mechanism 5. The moving mechanism 5 includes the link member 50, an urging spring 51, the sensor mounting member 52, and an urging spring 55.

The link member 50 is preferably a rigid bar member having a long axis in the Y-axis direction. A thin sliding portion 50*a* is arranged on a lower surface of the link member 50. The sensor mounting member 52 slides on the sliding portion 50*a*. As illustrated in FIG. 4, a thickness of the sliding portion 50*a* in its Z-axis direction gradually becomes thinner along the −Y direction.

A moving direction and a moving distance of the link member 50 are defined by a guide member (not illustrated). As illustrated with an arrow 102 in FIG. 2 and an arrow 103 of FIG. 4, the link member 50 advances and retracts only in the Y-axis direction. An end portion of the link member 50 located near the front cover 20 defines a contacting surface on which the protrusion 21 of the front cover 20 makes contact.

Under the state in which the front cover 20 is closed, the protrusion 21 makes contact with the contacting surface of the link member 50. That is, the link member 50 is pushed in the −Y direction by a leading edge of the protrusion 21, and a position of the contacting surface of the link member 50 is determined. Accordingly, as illustrated in FIG. 2, the link member 50 moves to a position where the link member 50 has moved the farthest in the −Y direction (hereinafter referred to as a "first position").

One end of the urging spring 51 is fixed with respect to the housing 2. Another end of the urging spring 51 is mounted on the link member 50. The urging spring 51 includes a function for urging the link member 50 in the +Y direction toward the cover 20.

Under the state in which the front cover 20 is opened, the protrusion 21 does not make contact with the contacting surface of the link member 50. That is, when the front cover 20 is opened, constraint by the protrusion 21 with respect to the link member 50 is eliminated. In this case, the link member 50 moves to a position where the link member 50 has moved the farthest in the +Y direction (a position illustrated in FIG. 4, hereinafter referred to as a "second position") by the urging force of the urging spring 51.

With the above-described structure, the link member 50 of the image forming device 1 moves in response to the opening or the closing movement of the front cover 20 and advances and retracts between the "first position" and the "second position".

A sliding portion 52*a*, a pair of shaft members 53, and a base loading portion 54 are provided on the sensor mounting member 52. The sliding portion 52*a* is arranged to protrude in a plate-like manner in a +Z direction from the sensor mounting member 52. An upper end of the sliding portion 52*a* slides against the sliding portion 50*a* of the link member 50. The shaft members 53 are respectively supported by supporting members (not illustrated) fixed on the housing 2 such that the shaft members 53 are respectively rotatable in a direction indicated by an arrow 104 in FIG. 5. That is, the sensor mounting member 52 is rotatable around a center axis (an axis substantially parallel to the Y-axis) of the shaft members 53 based on a position of the shaft members 53. The remaining amount detecting sensor 4 is mounted on the base loading portion 54 via a base 40. Accordingly, the sensor mounting member 52 can rotate stably without resistance by wiring or the like extending to the device main body from the board 40 arranged on the sensor mounting member 52.

The urging spring 55 is mounted at a position displaced in a +X direction from the position of the shaft members 53 (FIG. 3). Therefore, a force for rotating the sensor mounting member 52 in a counterclockwise direction in FIG. 5 acts upon the sensor mounting member 52 by the urging spring 55.

However, since the sliding portion 52*a* of the sensor mounting member 52 makes contact with the sliding portion 50*a* of the link member 50, a height position of the sliding portion 52*a* is restricted. That is, in the image forming device 1, a rotational position of the sensor mounting member 52 is defined by the height position (a position in the Z-axis direction) where the sliding portion 50*a* of the link member 50 makes contact with the sliding portion 52*a* of the sensor mounting member 52.

When the link member 50 moves between the "first position" and the "second position", a point where the sliding portion 52*a* of the sensor mounting member 52 makes contact with the link member 50 changes on the link member 50.

As described above, the thickness of the sliding portion 50*a* in the Z-axis direction changes along the Y-axis direction. In other words, the height position of the lower end of the sliding portion 50*a* differs in the Y-axis direction. Therefore, when the link member 50 moves in the +Y direction towards the front cover 20, the sensor mounting member 52 makes contact with a thinner portion of the link member 50. As a result, a position of the sliding portion 52*a* elevates. Accordingly, the sensor mounting member 52 is located at the rotational position illustrated in FIG. 5, and the remaining amount detecting sensor 4 is located at a position where the remaining amount detecting sensor 4 has been lowered the most (hereinafter referred to as a "retracted position").

Meanwhile, when the link member 50 moves away from the front cover 20 and moves in the −Y direction, the sensor mounting member 52 makes contact with the thicker portion of the sliding portion 50*a*. Therefore, the position of the sliding portion 52*a* is lowered. Accordingly, the remaining amount detecting sensor 4 is located at a most elevated position (hereinafter referred to as a "detecting position").

Figure 6:
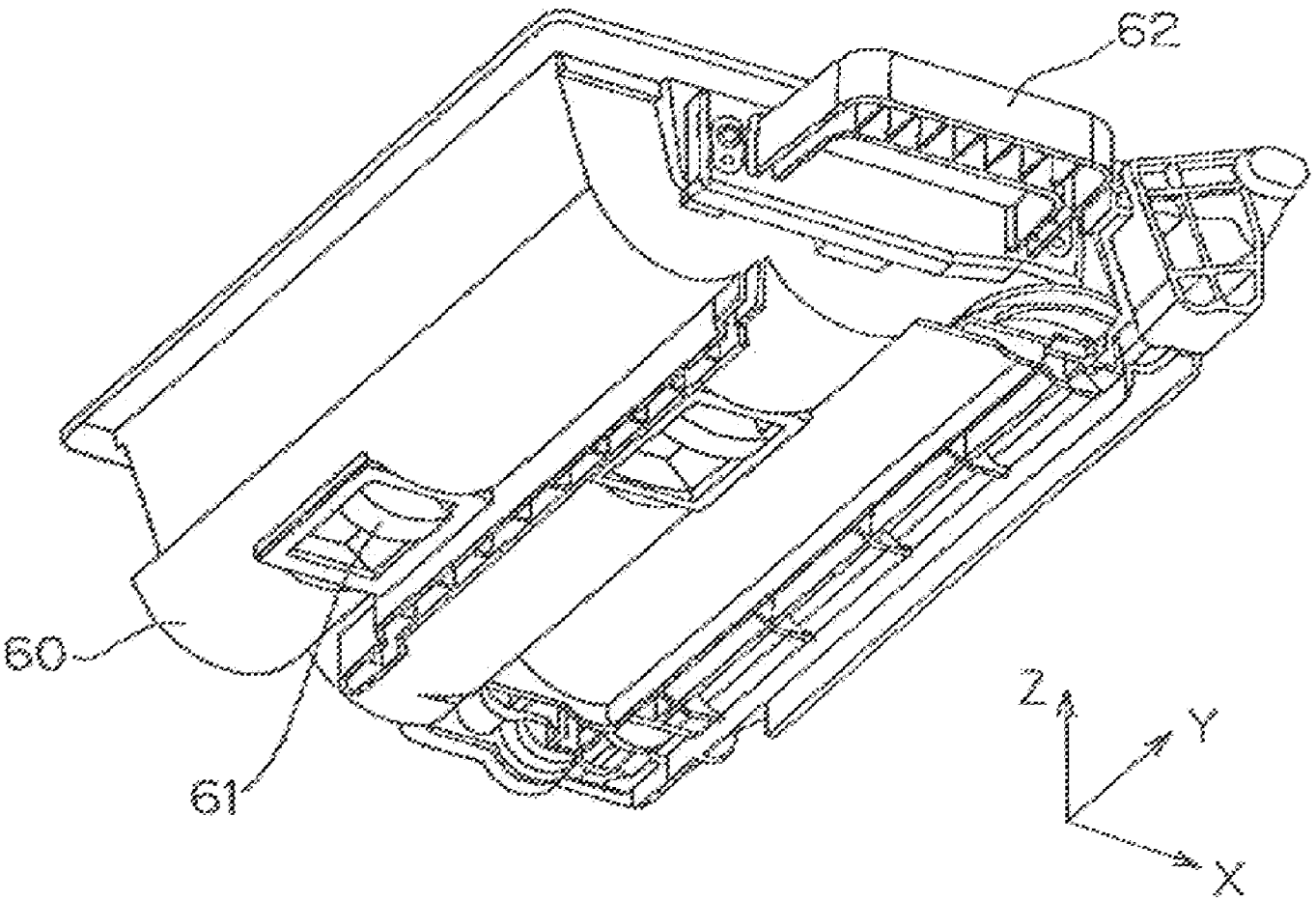
FIG. 6 is a schematic perspective view illustrating a developing unit.

FIG. 6 is a schematic perspective view illustrating the developing unit 6. The developing unit 6 includes a toner cartridge 60. A sensing window 61 is arranged on a bottom portion of the toner cartridge 60. The sensing window 61 is preferably a semi-transparent member. A handle 62 is arranged on the developing unit 6 so as to be grasped by the operator when the developing unit 6 is removed.

The developing unit 6 can be easily taken out from the image forming device 1 by the operator gripping the handle 62 and pulling the handle 62 in the +Y direction as illustrated by the arrow 101 in FIG. 1.

The toner cartridge 60 is a container in which the toner is accommodated. The toner cartridge 60 includes a function for supplying the toner to be used for an image printing operation performed in the image forming device 1. Although not illustrated in detail in the drawings, the toner cartridge 60 can be separated from the developing unit 6. Accordingly, when the toner runs out in the toner cartridge 60, the operator can replace the toner cartridge 60 with a new cartridge and the toner can be replenished to the image forming device 1.

The sensing window 61 is preferably formed as a semi-transparent protrusion, which is relatively thin in the Y-axis direction. A space is formed inside the sensing window 61 for accumulating toner. This space in the sensing window 61 is connected to an inner space (where the toner is accommodated) in the toner cartridge 60. Therefore, when the toner is consumed in the image forming device 1, the remaining amount of the toner in the sensing window 61 also decreases according to the remaining amount of the toner in the toner cartridge 60.

When the image forming device 1 is under a normal operation state, the sensing window 61 is located between the light emitting portion and the light receiving portion of the remaining amount detecting sensor 4 located at the detecting position. In other words, the remaining amount detecting sensor 4 located at the detecting position is inserted in the bottom portion of the toner cartridge 60 under a state in which the sensing window 61 is sandwiched in the remaining amount detecting sensor 4. The detecting light irradiated from the light emitting portion of the remaining amount detecting sensor 4 passes through the sensing window 61 and is received by the light receiving portion.

Meanwhile, when the remaining amount detecting sensor 4 descends and moves to the retracted position, the remaining amount detecting sensor 4 retracts sufficiently downward with respect to the toner cartridge 60. Under this state, even when the operator inserts or removes the developing unit 6 in the Y-axis direction, the developing unit 6 moving along a path does not interfere with the remaining amount detecting sensor 4 located at the retracted position.

As described above, in the image forming device 1, under a state in which the front cover 20 is closed, the link member 50 is pushed inward by the protrusion 21 and located at the first position. When the link member 50 is located at the first position, the remaining amount detecting sensor 4 is located at the detecting position. That is, under the state in which the front cover 20 is closed, the remaining amount detecting sensor 4 is located at the detecting position by the moving mechanism 5.

When the front cover 20 is opened, in response to this movement, the link member 50 moves to the second position by the urging force of the urging spring 51. In response to the movement of the link member 50 to the second position, the sensor mounting member 52 swings and the remaining amount detecting sensor 4 moves to the retracted position.

That is, under a state in which the front cover 20 is opened, the remaining amount detecting sensor 4 is located at the retracted position by the moving mechanism 5.

A conventional image forming device uses a driving mechanism, such as a motor, for retracting an optical sensor for detecting the remaining amount of the toner. The conventional image forming device requires a control appropriate for an opening or a closing movement of a front cover in order to operate such a driving mechanism.

However, in the image forming device 1 according to the present preferred embodiment of the present invention, the remaining amount detecting sensor 4 is moved between the "retracted position" and the "detecting position" in response to the opening or the closing movement of the front cover 20 by the moving mechanism 5, not by a driving mechanism such as a motor. The structure of the image forming device 1 is simplified and the manufacturing costs are minimized. Since the control unit 7 is not required to control the driving mechanism, throughput of the control unit 7 is increased.

Referring to FIG. 1 again, the control unit 7 includes a function as a general computer. Although not illustrated in the drawings, the control unit 7 includes a Central Processing Unit (CPU) for carrying out computations and the like, and a storage unit for storing data. The control unit 7 also controls other structural elements of the image forming device 1.

In particular, the control unit 7 determines whether the front cover 20 is opened or closed according to the open-close information transmitted from the open-close sensor 3.

When the control unit 7 receives the close information from the open-close sensor 3 and determines that the front cover 20 is closed, the control unit 7 executes the monitoring by the remaining amount detecting sensor 4. Specifically, when the front cover 20 is closed, the remaining amount detecting sensor 4 is switched ON.

When the front cover 20 is opened, since the remaining amount detecting sensor 4 has moved to the "retracted position", the sensing window 61 is not located between the light emitting portion and the light receiving portion of the remaining amount detecting sensor 4. Under this state, even when the remaining amount detecting sensor 4 is operated, the remaining amount detecting sensor 4 does not detect the remaining amount of the toner. Therefore, when the control unit 7 receives the open-close information from the open-close sensor 3 and determines that the front cover 20 is opened, the control unit 7 stops the monitoring by the remaining amount detecting sensor 4. Specifically, when the front cover 20 is opened, the remaining amount detecting sensor 4 is switched OFF.

Accordingly, the image forming device 1 can prevent a false detection by the remaining amount detecting sensor 4. Further, instead of switching the remaining amount detecting sensor 4 according to the opened or the closed state of the front cover 20, the control unit 7 may ignore the light intensity information from the remaining amount detecting sensor 4 only when the front cover 20 is opened.

The control unit 7 detects the presence or the absence of the toner cartridge 60 and the remaining amount of the toner in accordance with the light intensity information from the remaining amount detecting sensor 4.

Next, a description will be made of an operation for the control unit 7 to determine the presence or the absence of the toner cartridge 60.

When the toner cartridge 60 is not inserted, there is no object that shields the detecting light of the remaining amount detecting sensor 4. Therefore, the irradiated detecting light is received directly, and the light intensity indicated in the light intensity information takes a relatively large value (hereinafter referred to as a "light intensity value A").

As described above, the sensing window 61 of the toner cartridge 60 is preferably a semi-transparent member. When the sensing window 61 is located between the light emitting portion and the light receiving portion, the detecting light of the remaining amount detecting sensor 4 is partially shielded by the sensing window 61 regardless of the remaining amount of the toner. Therefore, when the toner cartridge 60 is properly inserted, the light intensity of the detecting light indicated in the light intensity information takes a smaller value compared with the light intensity value A.

The image forming device 1 measures a light intensity value output from the remaining amount detecting sensor 4 when a toner cartridge 60 without toner is inserted (hereinafter referred to as, a "light intensity value B"). Then, the image forming device 1 stores the light intensity value B as a threshold value. When determining the presence or the absence of the toner cartridge 60, the image forming device 1 compares the light intensity value indicated in the light intensity information at the current determination with the light intensity value B. When the measured light intensity value indicated in the light intensity information is a value larger than the light intensity value B (a value closer to the light intensity value A), the image forming device 1 determines that the toner cartridge 60 is not inserted. When the measured light intensity value indicated in the light intensity information is the light intensity value B or smaller, the image forming device 1 determines that the toner cartridge 60 is properly inserted.

As described above, the image forming device 1 includes the semi-transparent sensing window 61 to accurately determine the presence or the absence of the toner cartridge 60. Further, when the front cover 20 is opened and the remaining amount detecting sensor 4 is moved to the retracted position, even if the toner cartridge 60 is inserted, the detecting light of the remaining amount detecting sensor 4 is not shielded by the sensing window 61. However, as described above, since the remaining amount detecting sensor 4 is switched OFF by the control unit 7 in this case, the control unit 7 does not make a wrong determination that "the cartridge 60 is not inserted".

Next, a description will be made of an operation for the control unit 7 to determine the remaining amount of the toner in the toner cartridge 60. Since this operation is substantially the same as that of the conventional image forming device, the description will be brief.

The detecting light of the remaining amount detecting sensor 4 passing through the sensing window 61 is shielded also by the toner in the sensing window 61. That is, the light intensity value indicated in the light intensity information increases or decreases according to the remaining amount of the toner.

Therefore, when the light intensity value indicated in the light intensity information is a relatively small value, the control unit 7 determines that there is a sufficient amount of toner. When the light intensity value increases and approaches the light intensity value B, the control unit 7 determines that the remaining amount of the toner has decreased. At a point in time when the light intensity value indicated in the light intensity information reaches the light intensity value B, the control unit 7 ultimately determines that the toner has run out.

As described above, the image forming device 1 according to the present preferred embodiment includes the moving mechanism 5 for moving the remaining amount detecting sensor 4 between the retracted position and the detecting position by the link member 50, which moves in response to the opening or the closing movement of the front cover 20. Accordingly, the remaining amount detecting sensor 4 can be moved directly according to the movement of the front cover 20. As a result, a driving mechanism (for example, a motor) for retracting the remaining amount detecting sensor 4 becomes unnecessary. Therefore, the number of the components of the image forming device 1 can be reduced and the manufacturing costs of the image forming device 1 can be minimized. In addition, the control of the control unit 7 can be simplified.

The semi-transparent sensing window 61 is arranged on the toner cartridge 60. The control unit 7 detects the presence or the absence of the toner cartridge 60 according to the light intensity of the detecting light passing through the sensing window 61. Accordingly, the image forming device 1 is not required to include a separate sensor for detecting the presence or the absence of the toner cartridge 60. Therefore, the number of components of the image forming device 1 can be reduced, and the manufacturing costs of the image forming device 1 can be minimized.

The image forming device 1 further includes the open-close sensor 3 for detecting the opened or the closed state of the front cover 20. The control unit 7 determines the presence or the absence of the toner cartridge 60 according to the opened or the closed state of the front cover 20 detected by the open-close sensor 3 and the light intensity of the detecting light detected by the remaining amount detecting sensor 4. Accordingly, the image forming device 1 can accurately determine when the remaining amount detecting sensor 4 is located at the retracted position and when the toner cartridge 60 is not inserted.

Preferred embodiments of the present invention have been described. However, the present invention is not limited to the above-described preferred embodiments. The present invention may adopt various other preferred embodiments.

In the above-described preferred embodiments, the sensor mounting member 52 is urged by the urging spring 55 in the direction in which the remaining amount detecting sensor 4 descends, that is, it retracts. However, since the remaining amount detecting sensor 4 is mounted at a position displaced in the +X direction from the shaft members 53, the sensor mounting member 52 may be rotated by the weight of the remaining amount detecting sensor 4. That is, the urging spring 55 may be omitted.

The structure for transmitting the opening or the closing movement of the front cover 20 to retract the remaining amount detecting sensor 4 is not limited to the structure described in the above preferred embodiments. In order to retract the remaining amount detecting sensor 4 from the path of the developing unit 6, the image forming device 1 may include any mechanism for elevating or lowering the remaining amount detecting sensor 4 in response to the opening or the closing movement of the front cover 20.

The open-close sensor 3 is configured to receive the detecting light reflected by the front cover 20. An object that reflects the detecting light is not limited to the front cover 20. For example, the open-close sensor 3 may receive the detecting light reflected by the end portion of the link member 50. When irradiating the detecting light towards the front cover 20, the detecting light is irradiated towards an outer side of the image forming device 1. Thus, if some shielding object exists, there is a possibility of a incorrect detection. However, when irradiating the detecting light towards the end portion of the link member 50 at the −Y side, the inner structure of the image forming device 1 will be monitored. As a result, an occurrence of a wrong detection decreases.

In the above-described preferred embodiments, the control unit 7 determines the opened or the closed state of the front cover 20 according to the output signal (open-close information) from the open-close sensor 3. However, a method for the control unit 7 to determine the opened or the closed state of the front cover 20 is not limited to the above-described preferred embodiments. For example, at a point in time when the remaining amount detecting sensor 4 moves to the "retracted position", the remaining amount detecting sensor 4 may be electrically and/or mechanically disconnected. In this case, if the front cover 20 is opened, an output signal is not transmitted from the remaining amount detecting sensor 4. Therefore, when the control unit 7 does not receive the output signal from the remaining amount detecting sensor 4, the control unit 7 can determine that the front cover 20 is opened. The open-close sensing unit of a preferred embodiment of the present invention is achieved by the remaining amount detecting sensor 4 and the control unit 7. Accordingly, the open-close sensor 3 described in the above preferred embodiments is not required to be provided, and the number of components can be further reduced.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. An image forming device comprising:

a housing;

a cover arranged on the housing such that the cover can be opened and closed;

a container which accommodates toner and is removably inserted in the housing;

a detector arranged to detect a remaining amount of the toner in the container;

a link member which moves in response to an opening or a closing movement of the cover; and a moving mechanism which moves the detector between a retracted position and a detecting position via the link member.

2. The image forming device according to claim 1, wherein the container includes a semi-transparent sensing window, and the detector detects a presence or an absence of the container according to a light intensity of a detecting light passing through the sensing window.

3. The image forming device according to claim 2, further comprising a sensor arranged to sense an opened or a closed state of the cover, wherein the detector determines the presence or the absence of the container according to the light intensity of the detecting light and the opened or the closed state of the cover sensed by the sensor.

4. The image forming device according to claim 3, wherein the semi-transparent sensing window is arranged on a bottom portion of the container.

5. The image forming device according to claim 4, wherein the sensing window is a semi-transparent protrusion and includes an inner space for accumulating the toner, and the inner space is connected to an internal space of the container accommodating the toner.

6. The image forming device according to claim 5, wherein the detector includes a light emitting portion and a light receiving portion, and when the image forming device is under a normal operation state, the sensing window is located between the light emitting portion and the light receiving portion.

7. An image forming device comprising:

a housing;

a cover arranged on the housing such that the cover can be opened and closed;

a container which accommodates toner and is removably inserted in the housing;

a detector arranged to detect a remaining amount of the toner in the container;

a link member which moves in response to an opening or a closing movement of the cover;

a moving mechanism which moves the detector between a retracted position and a detecting position by the link member;

a sensor arranged to sense an opened or a closed state of the cover;

a control unit arranged to control the detector and the sensor; and a developing unit which develops the image.

8. The image forming device according to claim 7, wherein the sensor is a reflective optical sensor, and a detecting light of the optical sensor is irradiated in a same direction as a direction in which the container is removed from the housing.

9. The image forming device according to claim 8, wherein the moving mechanism includes the link member, two urging springs, and a sensor mounting member.

10. The image forming device according to claim 9, wherein the detector is a transmissive optical sensor in which a light emitting portion and a light receiving portion are arranged facing one another, and the transmissive optical sensor is mounted on the sensor mounting member.

11. The image forming device according to claim 10, wherein the detector is controlled by a control signal from the control unit and is switched between an ON state and an OFF state.

12. The image forming device according to claim 11, wherein the link member is a rigid bar member including a long axis extending in the direction in which the container is removed, and a sliding portion is arranged on a lower surface of the link member to make contact with the sensor mounting member.

13. The image forming device according to claim 12, wherein a thickness of the sliding portion of the link member in a vertical direction becomes gradually thinner towards an inside of the image forming device.

14. The image forming device according to claim 13, wherein a contacting surface is provided on an end portion of the link member located near the cover, and a protrusion provided on the cover makes contact with the contacting surface.

15. The image forming device according to claim 14, wherein the two urging springs includes a first urging spring which urges the link member in a direction towards a front of the housing.

16. The image forming device according to claim 15, wherein the sensor mounting member includes a sliding portion, a pair of shaft members, and a base loading portion.

17. The image forming device according to claim 16, wherein the sliding portion of the sensor mounting member protrudes upward from the sensor mounting member, and an upper end of the sliding portion of the sensor mounting member makes contact with the sliding portion of the link member.

18. The image forming device according to claim 17, wherein the sensor mounting member is rotatable around the pair of the shaft members.

19. The image forming device according to claim 18, wherein the detector is mounted on the base loading portion.

* * * * *